United States Patent [19]

Prindle et al.

[11] 4,046,093

[45] Sept. 6, 1977

[54] KICKUP RUDDER APPARATUS HAVING ADJUSTABLE RAKE

[75] Inventors: Geoffrey C. Prindle, Dana Point; J. Sterling Santley, South Laguna, both of Calif.

[73] Assignee: Surfglas, Inc., Santa Ana, Calif.

[21] Appl. No.: 658,285

[22] Filed: Feb. 17, 1976

[51] Int. Cl.[2] ..... B63H 25/06

[52] U.S. Cl. ..... 114/165

[58] Field of Search ..... 114/144 R, 162, 164, 114/165

[56] References Cited

U.S. PATENT DOCUMENTS

| | | | |
|---|---|---|---|
| 2,238,844 | 4/1941 | Arbeitlang | 114/165 |
| 2,992,623 | 7/1961 | Heckel, Jr. | 114/165 |
| 3,575,124 | 4/1971 | Alter | 114/165 |
| 3,728,983 | 4/1973 | Ingham | 114/165 |
| 3,731,645 | 5/1973 | Pearce | 114/162 |

*Primary Examiner*—Trygve M. Blix
*Assistant Examiner*—Stuart M. Goldstein
*Attorney, Agent, or Firm*—John Holtrichter, Jr.

[57] ABSTRACT

A rudder is pivotably mounted in an integral rudder-tiller support having a spring-loaded detent engageable by a lock on the rudder which may be adjusted to change rake and which may be released to free rudder to swing on its pivot by moving detent out of locking engagement with the lock.

5 Claims, 7 Drawing Figures

52
50
46
36
30
51
44
40
121
32
34
12
48
128
27
10
125
26
29
120
16
14
68
64
28
48
162
20
72
62
78
136
56
80
86
27
22
98
58
114
166
18
66
45
43
164
26
125
168
29

52
46
50
51
44
40
121
36
30
32
12
34
120
28
48
128
27
16
14
64
56
162
10
68
136
58
20
62
54
114
24
78
42
26
80
125
22
86
66
45
164
18
98
43
166
26
29
168
55

KICKUP RUDDER APPARATUS HAVING ADJUSTABLE RAKE

BACKGROUND OF THE INVENTION

FIELD OF THE INVENTION

The present invention pertains generally to the field of rudder apparatus for boats and more particularly to a new and useful kickup rudder apparatus having an adjustable rake.

SUMMARY OF THE INVENTION

It is a primary object of the present invention to provide a new and useful rudder apparatus for boats.

It is another object of the present invention to provide a kickup rudder apparatus having an adjustable rake.

According to the present invention, a rudder is pivotably mounted in a unitary rudder-tiller support carrying a spring-loaded detent engageable by an adjustable lock carried by the rudder.

The lock may be adjusted to control the rake of the rudder and is released from the detent when the rudder engages a fixed object. The detent may comprise a rod having its ends mounted in slots provided in the legs of the rudder-tiller support which may comprise a die-cast, bifurcated member. The rod may be biased to one end of the slot by a pair of springs each having one end connected to one end of the rod and another end connected to a rod having its ends fixedly mounted in the legs of the rudder-tiller support adjacent the detent. The detent may be moved against the force exerted by the springs by a first rope having one end connected to the rudder above its pivot and being trained about a first pulley rotatably mounted in the rudder-tiller support in line with the tiller; the rope then extends downwardly in the rudder-tiller support to a second pulley having its axle connected to the detent by suitable brackets; the rope is trained about this second pulley and extends upwardly in the rudder-tiller support to a third pulley mounted on the same axle which carries the first pulley; the rope is trained about this third pulley and extends through the tiller to a position where the second end of the rope may be grasped and pulled to simultaneously release the detent and swing the rudder.

A second rope may be pulled to re-engage the lock with the detent. This second rope has one end connected to the rudder below its pivot and below the lock; the second rope is trained about the fixed rod to which the springs are connected and passes up through the rudder-tiller support to a fourth pulley carried by the same axle which carries the first and third pulleys; the second rope is then trained about this fourth pulley and passes through the tiller where the second end of the second rope is accessible adjacent the second end of the first rope.

The features of the present invention which are believed to be novel are set forth with particularity in the appended claims. The present invention, both as to its organization and manner of operation, together with further objects and advantages thereof, may best be understood by making reference to the following description, taken in connection with the accompanying drawings, in which like reference numerals refer to like elements in the several views.

DESCRIPTION OF THE PREFERRED EMBODIMENT

Figure 1:
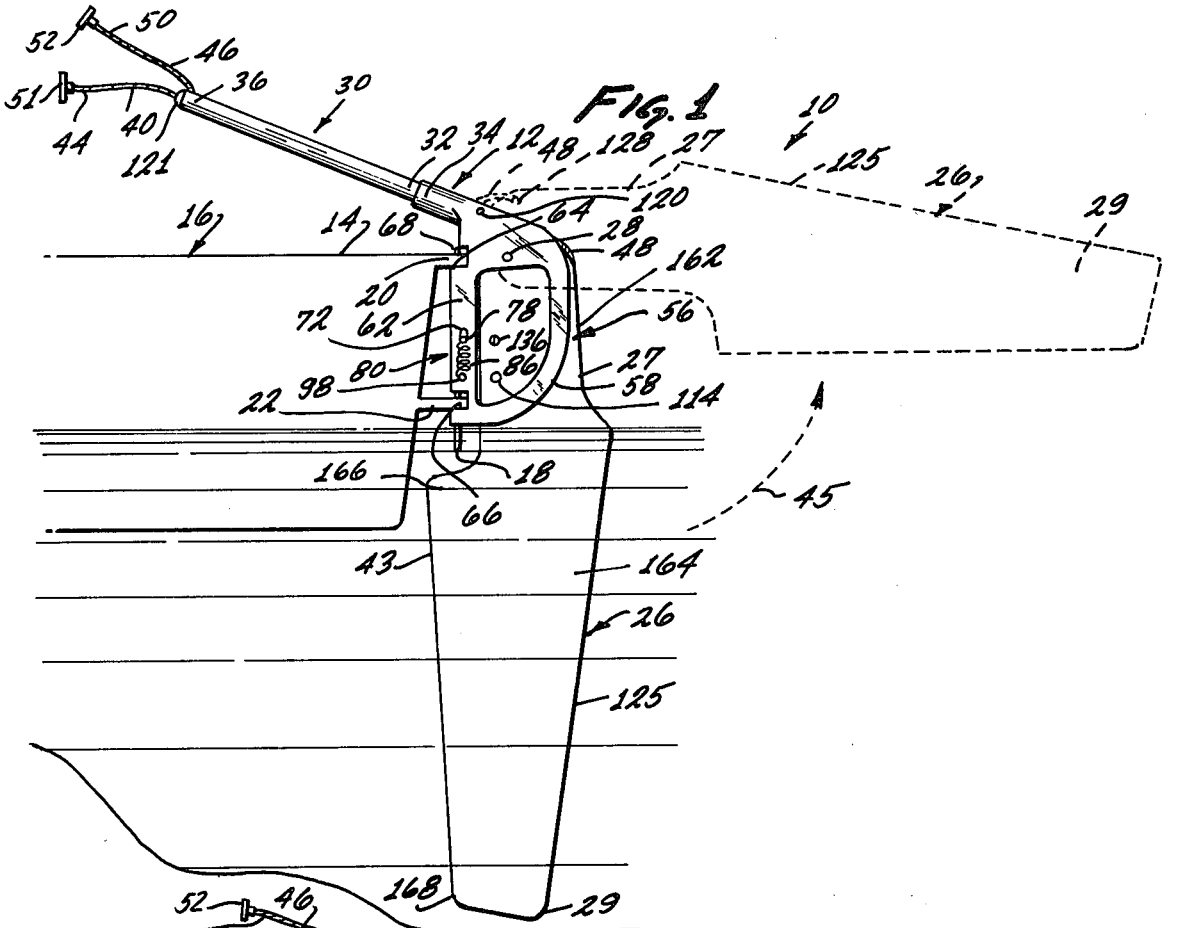
FIG. 1 is a front elevational view of a kickup rudder apparatus constituting a presently-preferred embodiment of the invention showing in broken lines, somewhat schematically, the rudder in a kickedup position.
Figure 2:
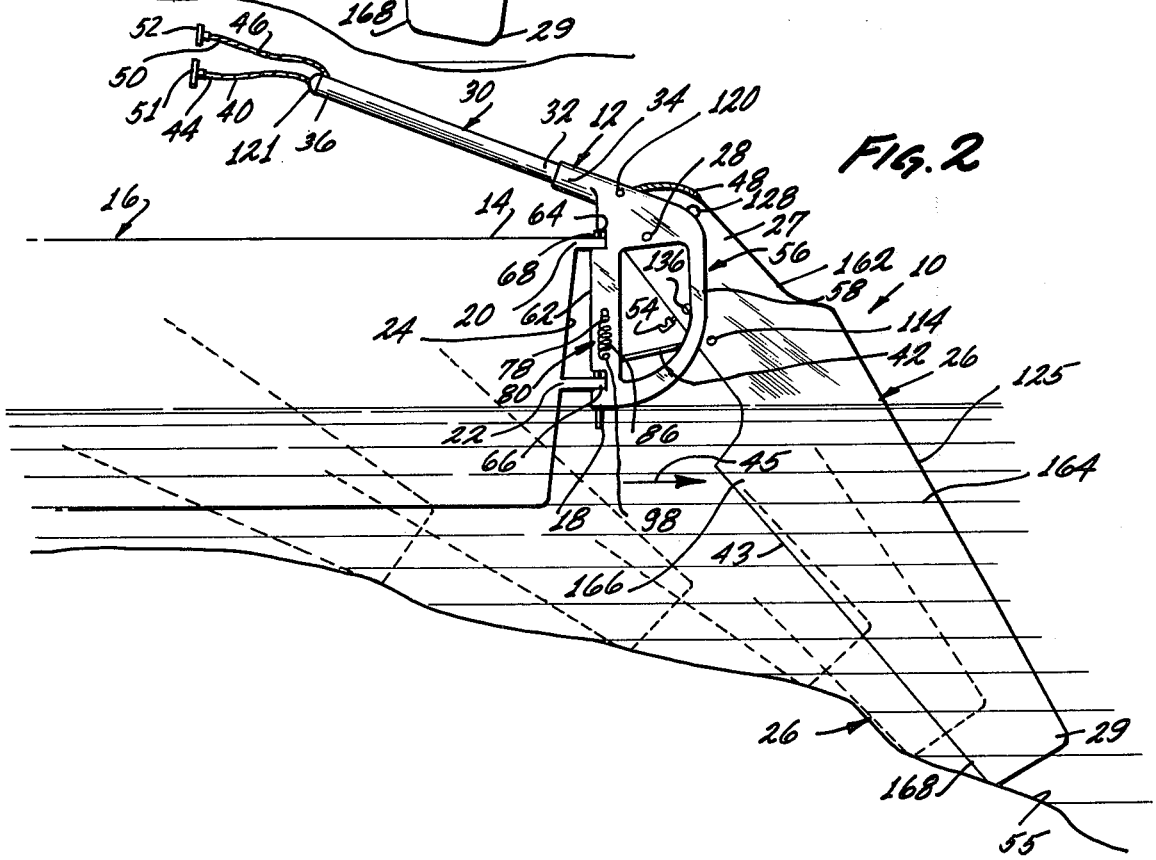
FIG. 2 is an elevational view of the device of FIG. 1 showing somewhat schematically how the rudder is automatically released when it engages a fixed object, as in moving the boat onto the beach.

Referring again to the drawings, and more particularly to FIGS. 1 and 2, a kickup rudder apparatus constituting a presently-preferred embodiment of the invention, generally designated 10, includes a unitary rudder-tiller support 12, swingably connected to the stern portion 14 of a boat 16 by a pivot pin 18 engaged in a pair of gudgeons 20, 22 affixed to a transom 24 on boat 16.

The kickup rudder apparatus 10 also includes a rudder 26 having an upper end 27 pivotably mounted in support 12 by a pivot pin 28 for swinging movements between the positions shown in solid and broken lines in FIGS. 1 and 2. Apparatus 10 also includes a tiller 30 which may be a hollow, tubular member having a first end 32 frictionally engaged in a socket 34, which forms an integral part of the unitary rudder-tiller support 12, and a free end 36. An attachment member (not shown) may be provided adjacent free end 36 for connecting rudder apparatus 10 to a second rudder apparatus (not shown) when boat 16 is a catamaran, or the like, which uses two rudders. Rudder 26 may be moved from the position shown in broken lines in FIG. 1 to the locked position shown in solid lines in FIG. 1 by a first rope 40 having a first end 42 connected to the leading edge 43 of rudder 26 below pivot pin 28 and a second end 44 extending from the free end 36 of tiller 30. Rudder 26 may be kicked up in the direction of arrow 45 from the position shown in solid lines to the position shown in broken lines in FIG. 1 by pulling a second rope 46 having a first end 48 connected to rudder 26 above pivot pin 28 and a second end 50 extending from the free end 36 of tiller 30. End 44 of rope 40 and end 50 of rope 46 may be provided with a suitable handles 50, 52, respectively, if desired. The leading edge 43 of rudder 26 carries an adjustable latch or lock 54 (FIG. 2) engageable with a spring-loaded detent mechanism (to be hereinafter described) for securing rudder 26 in its down or operative position; for automatically releasing rudder 26 when its lower end 29 engages a fixed object 55 and, as will be described hereinafter, for changing the rake of rudder 26.

Figures 3, 5:
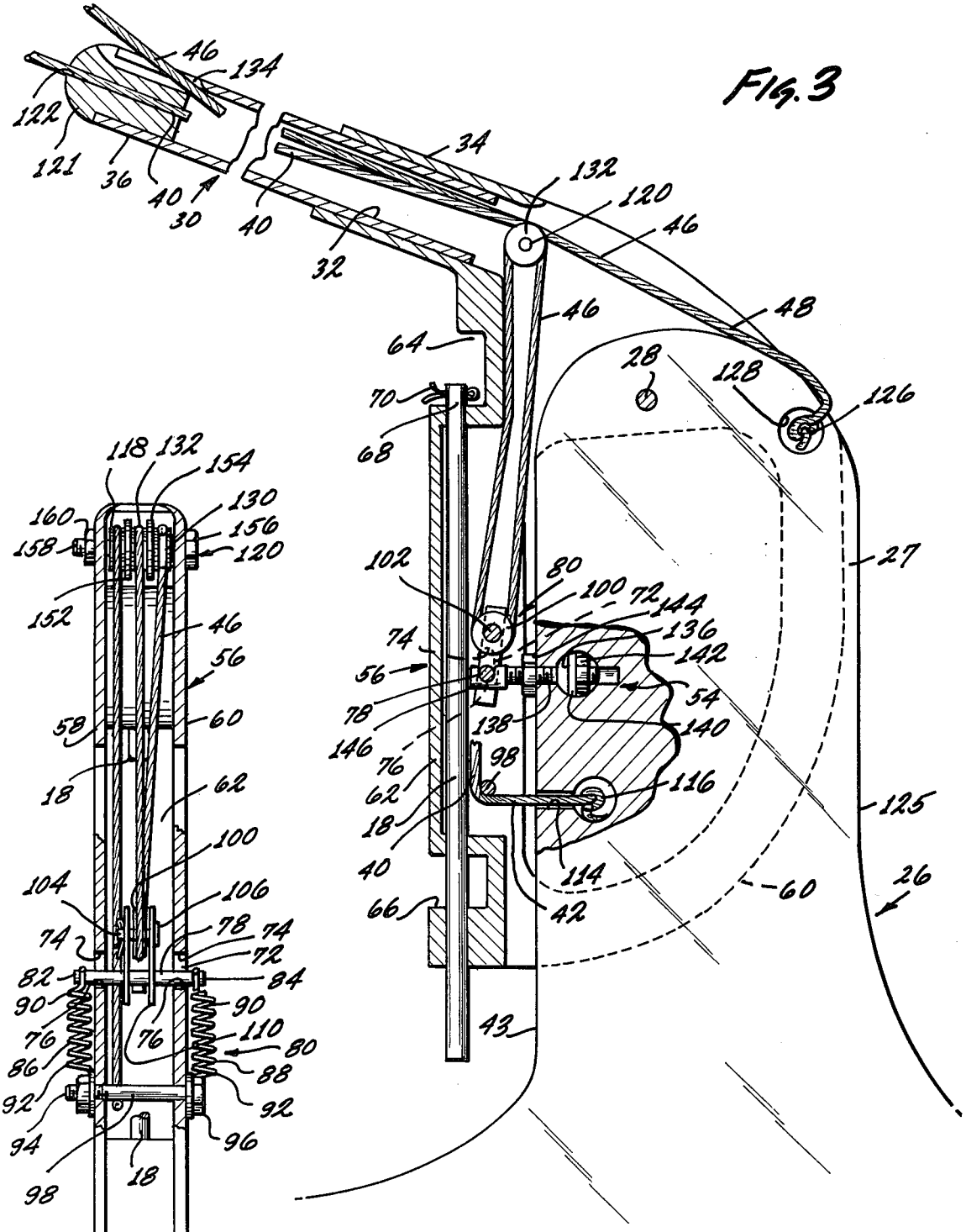
FIG. 3 is an enlarged partial elevational view of the rudder apparatus of FIG. 1 with parts broken away to show internal construction.
FIG. 5 is a partial cross-sectional view of a rudder support portion of the rudder apparatus to FIG. 1.
Figure 4:
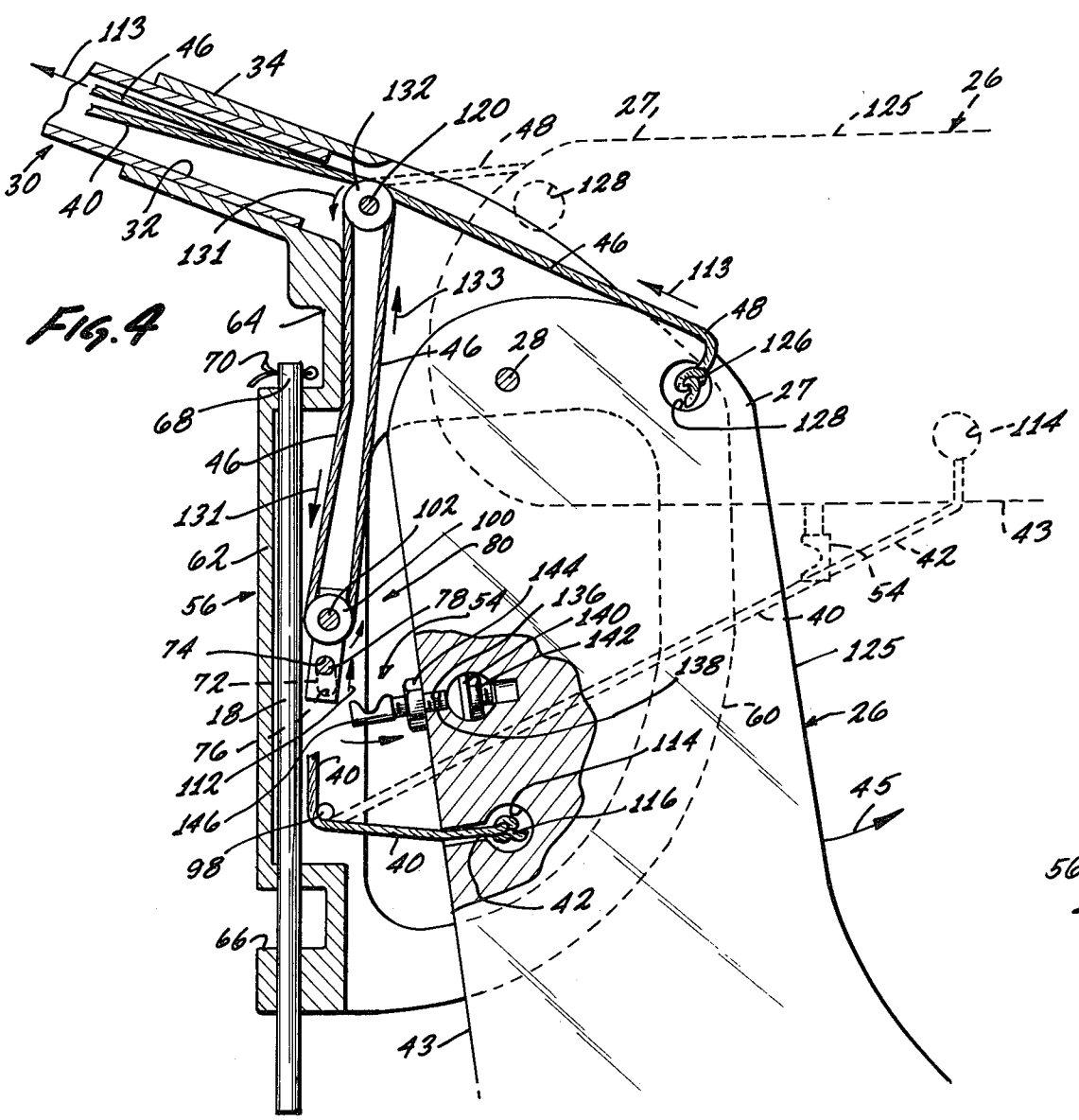
FIG. 4 is a view similar to FIG. 3 showing the rudder in a released position in solid lines and in a kickedup position in broken lines.

Referring now to FIGS. 1–5, socket 34 on support 12 merges into a bifurcated member 56 having a pair of D-shaped legs 58, 60, and a bight portion 62. A pair of notches 64, 66 are provided in bight portion 62 for receiving gudgeons 20, 22, respectively. The upper end 68 of rod 18, may be retained in position in notch 64 above gudgeon 20 by a suitable cotter pin 70 (FIGS. 3 and 4). Each leg 58, 60 is provided with a slot 72 (FIG. 5) having an upper end 74 and a lower end 76, between which a detent 78, forming part of a spring-loaded detent mechanism 80, has its ends 82, 84 slideably mounted on legs 58, 60, respectively. Detent 78 is biased against ends 76 of slots 72 by a pair of springs 86, 88 having first ends 90 connected to ends 82, 84, respectively, of detent 78 and second ends 92 connected to the ends 94, 96, respectively, of a rod 98 fixedly mounted in the legs 58, 60 below detent 78. Detent mechanism 80 includes a pulley 100 rotatably mounted on an axle 102 having its ends 104, 106 affixed to a pair of brackets 108, 110, respectively, carried by detent 78.

Lock 54 is engageable with detent 78 to lock rudder 26 in its FIG. 1 solid-line position. It will be understood by those skilled in the art that springs 86, 88 permit lock 54 to be released when rudder 26 meets an obstruction. Lock 54 may also be released by moving detent 78 in the direction of arrow 112 (FIG. 4) by pulling on rope 40. End 42 of rope 40 may be threaded into a first keyhole-shaped channel 114 provided in rudder 26 and secured in position therein by tying a knot 116 in end 42. Rope 40 may then be trained about rod 98 and passed upwardly inside support 12 along bight portion 62, to a first pulley 118 (FIGS. 5 and 7) rotatably mounted on an axle 120 mounted in support 12 adjacent socket 34; rope 40 may then be trained about pulley 118 and passed through socket 34, tiller 30 and a knob 121 (FIG. 3) provided on the free end 36 of tiller 30; an aperture 122 may be provided in knob 121 for rope 40.

End 48 of rope 46 may be attached to the trailing edge 125 of rudder 26 by trapping a knot 126, which may be provided on end 48 of rope 46, in a second keyhole-shaped channel 128 provided in rudder 26. Rope 46 may then be trained about a second pulley 130 (FIGS. 5 and 7), which is also rotatably mounted on axle 120, and passed downwardly in the direction of arrows 131 (FIG. 4) through support 12 to pulley 100, which may now be referred to as a third pulley; rope 46 may then be trained about the third pulley 100 and passed upwardly in the direction of arrows 133 through support 12 to a fourth pulley 132, which is also rotatably mounted on axle 120; rope 46 may then be trained about pulley 132 and passed through socket 34, tiller 30 and a slot 134 (FIG. 3) provided in knob 121.

Figure 6:
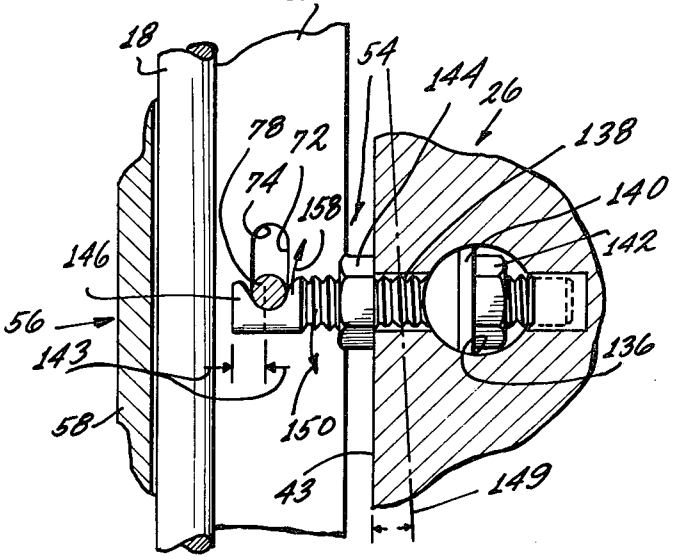
FIG. 6 is an enlarged view of the detent and lock portions of the rudder apparatus of FIG. 1.

Rudder 26 may be provided with a third keyhole-shaped channel 136 (FIGS. 3, 4 and 6) in which the threaded end 138 of latch 54 is mounted in a metal washer 140 and a nut 142. Latch 54 may be adjusted, as indicated by arrows 143 in FIG. 6, by loosening a lock nut 144 and rotating the hooked end 146 of latch 54 in the direction of arrow 150; this may be done for the purpose of adjusting the rake on rudder 26 from the position shown in solid lines in FIG. 6 aft to the position indicated schematically by line 149. The adjustable latch 54 is an important feature of the invention because it permits adjusting the rake of rudder 26 either fore or aft to balance the helm of boat 16 exactly the way the skipper wants it. Alternatively, latch 54 may be rotated in the direction of arrow 150 to adjust rudder 26 fore from the position shown in FIG. 6.

Figure 7:
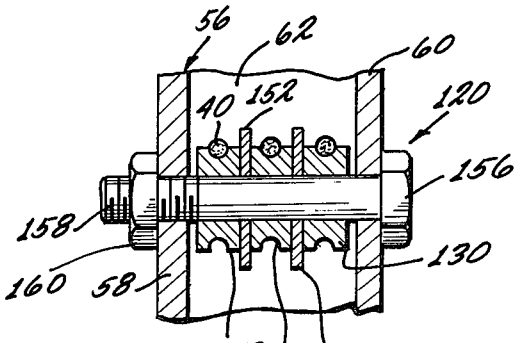
FIG. 7 is an enlarged view of the upper rollers and ropes used in the rudder apparatus of FIG. 1.

As best shown in FIGS. 5 and 7, pulleys 118, 132 may be separated by a first thrust washer 152 and pulleys 132, 130 may be separated by a second thrust washer 154 mounted on axle 120 which may consist of a bolt having a head 156 and a threaded end 158. A nut 160 may be used to secure axle 120 in position on bifurcated member 56.

Referring again to FIGS. 1 and 2, rudder 26 is shown herein for purposes of illustration, but not of limitation, as having a throat portion 162 fitting within support 12 and a body portion 164 tapering from a comparatively wide portion 166 adjacent throat position 162 to a narrower portion 168 at end 29.

Operation of rudder apparatus 10 is believed to be apparent and is briefly summarized at this point. Rudder 26 may be moved into the direction of arrow 45 to the position shown in broken lines in FIG. 1 by pulling handle 52 causing rope 46 to move pulley 100 and detent 78 in the direction of arrow 112 (FIG. 4) for releasing latch 54; continued pulling on rope 46 swings rudder 26 about pivot pin 28 until rudder 26 is approximately normal to the position shown in solid lines in FIG. 1. Rudder 26 may be held in this position by engaging rope 46 in slot 134. As best shown in FIG. 2, boat 16 may be sailed onto a beach, as represented by obstruction 55, whereupon rudder 26 will automatically kickup when its leading edge 43 engages beach 55 causing latch 54 to be released from detent 78.

Boat 16 may also be sailed from a beach into a body of water by starting with the rudder in its up position. Gravity will pull rudder 26 into engagement with the surface of beach 55 so that rudder 26 will be effective when boat 16 first enters the water. Rudder 26 may be maintained in contact with the surface beneath shallow water against the drag imparted to the leading edge 43 of rudder 26 by the water by pulling on rope 40 to rotate rudder 26 about pivot pin 28 in a clockwise direction, as viewed in FIG. 3. Continued pulling on rope 40 when boat 16 is in deep water will bring latch 54 into locking engagement with detent 78.

Although the invention has been herein shown and described in what is conceived to be the most practical and preferred embodiment, it is recognized that departures may be made therefrom within the scope of the invention, which is not to be limited to the illustrative details disclosed.

What is claimed is:

1. In a kickup rudder apparatus including a rudder, the improvement comprises:

means for adjusting the rake of said rudder including a spring-loaded detent engageable by an adjustable lock, said detent including a rod slidably mounted in a slot and springs biasing said rod to one end of said slot, said lock comprising a threaded bolt; and means connected to said detent for manually moving it out of engagement with said lock, said detent releasing said lock when said rudder engages a fixed object, whereby said rudder will kickup.

2. A kickup rudder apparatus comprising:

a unitary rudder-tiller support having a spring-loaded detent mounted therein;

a rudder rotatably mounted in said rudder-tiller support; and a lock including an elongated rod having a detent-engageable end and an adjustable end provided on said rudder in a position such that said lock will only engage said detent when said rudder is swung to a down position, said lock including means operatively coupled to said adjustable end for adjusting the distance of said detent-engageable end relative to said rudder and thereby changing the rake of said rudder.

3. A kickup rudder apparatus as stated in claim 2 including first flexible cable means connected to said detent and to said rubber for manually moving said detent out of engagement with said lock and substantially simultaneously swinging said rudder to an elevated position.

4. A kickup rudder apparatus as stated in claim 2 including second flexible cable means connected to said rudder for manually moving it to a down position where said lock engages said detent.

5. A kickup rudder apparatus, comprising:

a bifurcated rudder support having a pair of legs and a bight portion, said rudder support having an upper end and a lower end;

a rudder having an upper end, a lower end, a leading edge, a trailing edge and a throat portion, said throat portion being adjacent said upper end;

a pivot pin rotatably mounting said throat portion of said rudder in said rudder support between said legs;

a spring-loaded detent mounted in said rudder support below said pivot pin;

a latch releasably connecting said leading edge of said rudder to said spring-loaded detent;

a first rope connected to the trailing edge of said rudder above said pivot pin and to said detent for releasing said latch and swinging said rudder about said pivot pin to a kickedup position; and a second rope connected to the leading edge of said rudder below said latch for pulling said rudder into locked engagement with said rudder support.

* * * * *